United States Patent [19]

Parker

[11] Patent Number: 4,792,058

[45] Date of Patent: Dec. 20, 1988

[54] BUSINESS CARD DISPENSER

[76] Inventor: Robert J. Parker, 805 E. Moler Ave., Martinsburg, W. Va. 25401

[21] Appl. No.: 45,474

[22] Filed: May 4, 1987

[51] Int. Cl.[4] ..... B65D 83/12; B65H 1/04

[52] U.S. Cl. ..... 221/232; 206/39.4; 221/276

[58] Field of Search ..... 221/232, 271, 276; 206/39.4, 39.5; 312/61; 211/51; 453/48, 47

[56] References Cited

U.S. PATENT DOCUMENTS

| | | | |
|---|---|---|---|
| 806,985 | 12/1905 | Mallory | 206/39.5 |
| 909,110 | 1/1909 | O'Neil | 221/232 |
| 1,244,338 | 10/1917 | Johnson | 221/232 |
| 1,503,144 | 7/1921 | Warwick . | |
| 1,697,366 | 10/1927 | Opfergelt | 221/232 |
| 2,152,174 | 12/1937 | Brunetti | 221/232 |
| 2,591,855 | 4/1950 | Nicholson | 221/270 |
| 2,803,378 | 5/1952 | Gundling | 221/232 |
| 2,973,882 | 3/1959 | Jeffus | 221/270 |
| 3,131,806 | 5/1964 | Tait et al. | 221/268 |
| 3,308,989 | 10/1965 | Alltop et al. . | |
| 3,393,831 | 11/1966 | Stewart | 221/268 |

FOREIGN PATENT DOCUMENTS

| | | | |
|---|---|---|---|
| 613465 | 1/1961 | Canada | 221/271 |

*Primary Examiner*—F. J. Bartuska

*Attorney, Agent, or Firm*—Dowell & Dowell

[57] ABSTRACT

A pocket-sized dispenser for business or calling cards which includes a case having generally continuous upper and lower surfaces upon which advertising or identification indicia may be displayed and in which the cards are protectively housed for selective dispensing utilizing a reinforced and automatically retracted ejector mechanism which is compactly oriented within the case and is operable through a side wall thereof.

16 Claims, 3 Drawing Sheets

BUSINESS CARD DISPENSER

BACKGROUND OF THE INVENTION

1. Field of the Invention

This invention is generally directed to portable dispensers for selectively dispensing sheet-like articles and particularly to a portable business or calling card dispenser which is of a size to be carried in a person's pocket and which includes a housing having a slideable cover by way of which cards may be inserted therein. The case of the dispenser includes generally continuous upper and lower planar surfaces which may be utilized to display various advertising or identification indicia. The ejector mechanism for the dispenser is uniquely designed to cooperate with the internal portion of the case so that the dimension of the case is just slightly larger than the dimension of the cards carried therein. The cards are positively biased toward the ejector in a vertical array by way of a generally continuous plate having a plurality of integrally formed spring-like portions that are generally equally or uniformly oriented along the undersurface thereof. The ejector mechanism includes portions which extend through a side wall of the housing in order to allow the ejector to be selectively operated and is resiliently returned to a seated position within the housing after a card has been urged from the case.

2. History of the Related Art

Heretofore, there have been many inventive efforts directed to providing dispensers for sheet-like materials or articles including cards, tickets, chewing gum, razor blades and the like. Most of these dispensers have been designed to be portable and carried in a person's pocket and include a housing in which the articles to be dispensed are housed in stacked relationship. Most of the prior art dispensers further include an ejector which is slideably carried by a portion of the case or housing and which acts to urge a single article from the housing by being manipulated toward one end thereof.

Many such prior art dispensers have not proven to be reliable or effective for continuously dispensing a single article at a time from the housing or case in which the articles are stored. In other such portable dispensers, the size of the housings or cases are necessarily enlarged in order to provide operative clearance for the ejection mechanisms incorporated therewith. In addition, prior art portable dispensers of the type for dispensing small articles have generally not been designed to simultaneously function as a means of identification or as an advertising display case.

Many prior art small portable article dispensers include an enclosed housing having upper and lower and side surfaces which substantially enclose the articles to be dispensed. The ejector mechanism is mounted within the housing and includes one end portion which engages an end of the upper article in a stack of articles in such a manner that the ejector will urge the article outwardly through an opening in the case when operated by an appropriate push button or lever which extends outwardly of the case. In order to insure that the articles contained within the various cases are continuously or sequentially presented to the ejector mechanism, use is traditionally made of a separate spring member which is mounted in the housing and which engages the lower article in a stack of articles and which is utilized to force the stack of articles toward the ejector.

Many portable prior art dispensers include an operating mechanism which extends through the upper surface of the case or housing and which is reciprocally movable with respect thereto. When being transported, it is possible for the operating mechanism to be accidentally moved forwardly or shifted thereby discharging or partially discharging an article from the case as the case is being carried or being placed into or removed from a person's pocket. Such premature ejection of an article not only is undesirable but creates problems with having to reinsert the article for future dispensing or will result in an article, such as a flexible card, being damaged.

In prior art portable pocket dispensers which are designed so that the operating mechanism extends from the upper surface thereof, the operating mechanisms prevent the use of the upper surface for displaying advertising or identification which could otherwise be associated with the dispenser housing or case. Some examples of such dispensers are disclosed in U.S. Pat. Nos. 1,503,144 to Warwick, 1,697,366 to Opfergelt, 2,152,174 to Brunetti, 2,591,855 to Nicholson, 2,973,882 to Jeffus, 3,308,989 to Alltop et al. and 3,393,831 to Stewart.

In an effort to overcome the accidental discharge of small articles from portable article dispensers, some prior art dispensers have been provided with return springs which will operatively retain the ejector control mechanism in a relatively fixed position within the dispenser case or housing. Movement of the ejector mechanism is then only possible if a sufficient force is provided to move the mechanism against the tension of the spring. In this manner, such ejectors will be retained in a non-dispensing position when being transported or carried. An example of such a resiliently biased dispensing mechanism is disclosed in U.S. Pat. No. 2,803,378 to Gundling.

As previously mentioned, many prior art portable article dispensers generally have been designed to be of a large enough size to allow substantial clearance from the injector mechanism relative to a stack of articles contained within the dispenser case or housing thereby permitting the ejector mechanisms to be aligned with the rear of the uppermost article to be dispensed. Unfortunately, the need for clearance has required that most prior art dispensers be manufactured of a size which is significantly greater than the article to be dispensed thereby making the dispensers more difficult to handle and expensive to manufacture.

Other prior art portable dispensers are disclosed in U.S. Pat. Nos. 909,110 to O'Neil, 1,244,338 to Johnson and 3,131,806 to Tait et al.

SUMMARY OF THE INVENTION

This invention is directed to a portable article dispenser of the type which is specifically designed to dispense business or calling cards and which includes a case having generally continuous upper and lower walls which are oriented generally parallel with respect to the cards which are to be carried therein and which also includes substantially closed side and end wall portions. An opening is provided along one end portion through which cards may be selectively dispensed by means of an ejector mechanism which is slideably mounted within the casing. The ejector mechanism includes a body portion which extends generally parallel to one of the side walls and adjacent thereto and from which a pair of push button mounting flanges are integrally formed so as to be disposed outwardly through a slot formed in the adjacent side wall. The ejector mechanism also includes a card engaging depending flange which extends generally perpendicularly with respect to the main body portion and which is reinforced and integrally connected thereto by means of a generally triangular flange element which is beveled along its front edge so as to not interfere with the movement of cards which are stacked within the casing. An elongated recess is provided in the end wall of the dispenser case opposite the end wall having the opening therein in which the card engaging flange is selectively seated when the ejector mechanism is fully retracted within the housing. A mounting stud extends inwardly of the side wall of the case having the opening therein and which stud also extends through an elongated opening in the main body portion of the ejector mechanism whereby the ejector element may be movable with respect thereto. An elastic member is mounted around the fixed stud and extends forwardly and around one of the mounting flanges for the push button. The cards are positively biased within the case toward the ejector mechanism by a movable card support plate which is resiliently biased upwardly away from the bottom wall of the casing by a plurality of integrally formed spring elements which extend downwardly therefrom into engagement with the bottom wall. The card support plate includes a plurality of outwardly extending flanges which are guidingly engaged in cooperative slots or grooves which are provided in the side and end walls of the dispenser case. Each of the slots or grooves is terminated at a point below the upper edge of the walls so that the movable card support plate is positively retained within the case when in its uppermost position. The upper surface of the case or lid is frictionally secured and normally closed with respect to the side and end walls but may be raised and slidingly urged rearwardly with respect to the dispensing slot in one end wall so that cards may be introduced into the dispenser.

It is a primary object of the present invention to provide a dispenser for business cards and the like wherein the cards are retained within a relatively compact portable casing which is generally of a size which is only slightly larger than the size of the business cards so as to be as compact as possible.

It is another object of the present invention to provide a dispenser for housing a plurality of business cards wherein the upper and lower surfaces of the dispenser are generally continuous and unobstructed so that advertising or identification indicia may be selectively carried along either of the lower or upper surfaces to either identify the company or organization to which a business person belongs or to advertise goods or services which may be of interest to the business person.

It is another object of the present invention to provide a dispensing apparatus which may be easily transported in a person's pocket and which is designed to selectively dispense business or calling type cards wherein the ejector mechanism is operative through the side wall of the casing of the dispenser and is resiliently urged toward a normally fully retracted rest position when not being manually operated to dispense a card therefrom.

It is also an object of the present invention to provide a low cost and yet durable dispenser for business and calling cards wherein the cards are uniformly urged toward an ejector mechanism mounted within the dispenser by a support plate of a size generally equal to the size of the cards so that the pressure being applied to the cards is uniformly distributed throughout the length of the cards thereby preventing any bending or twisting of the cards when being dispensed.

Another object of the present invention is to provide a portable dispenser for business or calling cards wherein the dispensing case is locked into an assembled configuration so that the cards carried therein may not be accidentally discharged therefrom by portions of the case being accidentally opened yet wherein access may be obtained by specifically urging the lid portion of the case relative to an end wall thereof to dislodge the same for limited sliding or reciprocal movement with respect thereto.

It is also an object of the present invention to provide an ejector mechanism for use with portable pocket dispensers for dispensing generally flat articles which are oriented in stacked relationship such as business or calling cards wherein the ejector mechanism includes an enlarged reinforcing flange member which is perpendicularly oriented with respect to the cards so as to engage the upper card over an extended portion thereof to thereby insure that the rear edge is appropriately aligned for proper dispensing.

DESCRIPTION OF THE PREFERRED EMBODIMENT

Figures 1, 1A, 2, 2A, 2B, 2C:
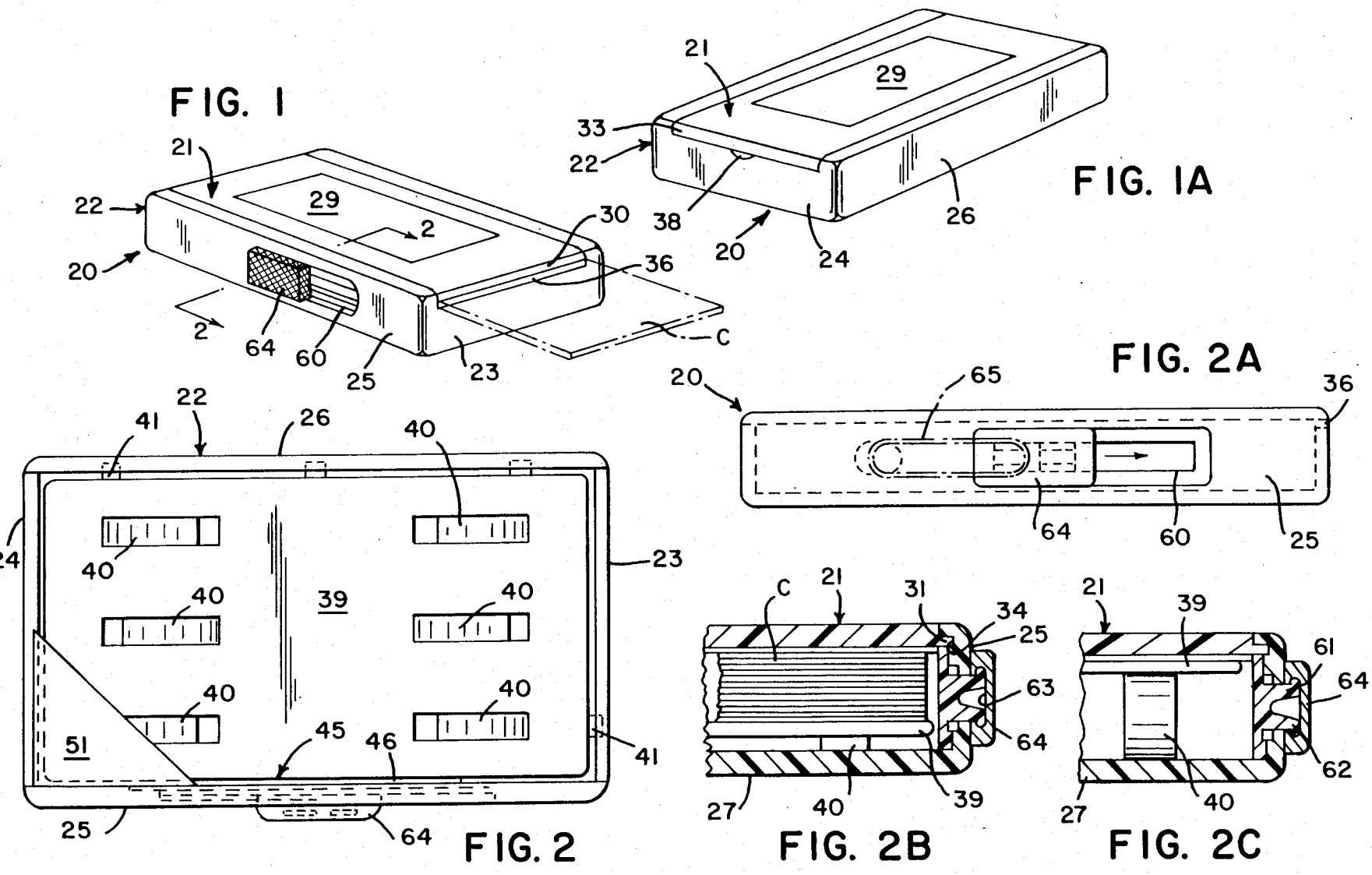
FIG. 1 is a perspective illustrational view taken from the forward end of the business card dispenser of the present invention showing a business card being dispensed therefrom in dotted line.
FIG. 1A is a perspective view taken from the back side of the business card dispenser shown in FIG. 1.
FIG. 2 is an enlarged top plan view of the business card dispenser of FIG. 1 having the lid of the dispenser removed so as to expose the ejector mechanism and card support plate of the present invention.
FIG. 2A is an enlarged right side view of the business card dispenser as shown in FIG. 1.
FIGS. 2B and 2C are enlarged partial cross sectional views taken along lines 2—2 of FIG. 1 showing in FIG. 2B the position of the inner card support plate when a plurality of cards are placed within the dispenser and FIG. 2C indicates the position of the card support plate when no cards are retained within the dispenser.
Figure 6:
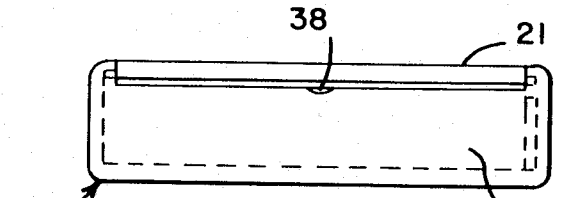
FIG. 6 is an enlarged rear elevational view of the card dispenser of the present invention.
Figure 7:
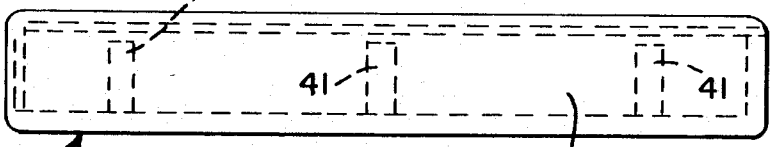
FIG. 7 is an enlarged left side view of the card dispenser of the present invention as shown in FIG. 1.
Figure 8:
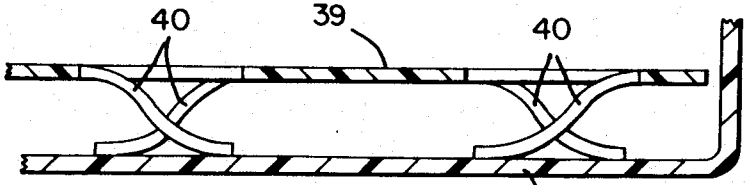
FIG. 8 is an enlarged partial cross sectional view showing the relationship between the card support plate and the bottom wall of the card dispenser of the present invention.
Figure 3:
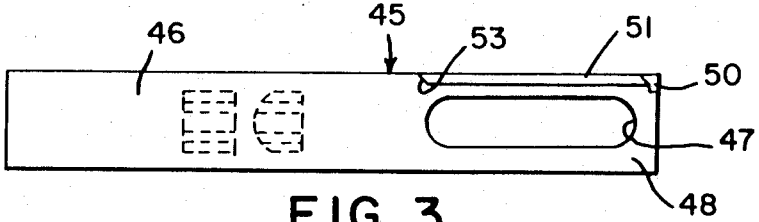
FIG. 3 is an enlarged side elevational view of the ejector mechanism of the present invention.
Figure 4:
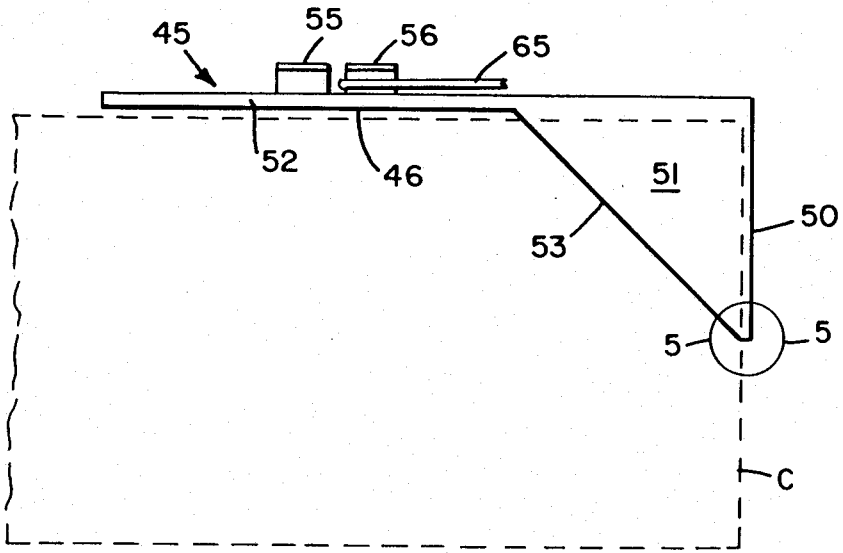
FIG. 4 is a top plan view of the ejector mechanism of FIG. 3 showing the relationship of a card to be ejected in dotted line and showing a portion of the resilient return member which is associated therewith.

With continued reference to the drawings, the business card dispenser of the present invention is shown in FIGS. 1 and 1A in perspective view. The business card dispenser is specifically designed to be compact and of a size which is just slightly larger than a conventional business or calling card C. The size of the business card dispenser will therefore facilitate the carrying of the dispenser in a person's coat or pants pocket or purse.

The business card dispenser includes a case 20 having a slideable lid portion 21 which is selectively movable with respect to a base portion 22. The base portion has forward and rear ends 23 and 24, respectively, which are integrally joined on either side by elongated side walls 25 and 26. The front, rear and side walls are joined by a common bottom wall 27 so as to form a substantially enclosed chamber 28 in which the business or other types of cards are retained for selective dispensing.

The lid is generally rectangular in configuration and includes a generally continuous and planar upper surface 29 and a front edge 30. The front edge extends slightly outwardly from longitudinally extending side flanges 31 and 32 which generally terminate in line with a slightly depending rear wall 33. The lid 21 is designed to cooperatively seat and be engaged with the body portion 22 of the dispenser and to this extent, the body portion includes a pair of opposing and spaced elongated recesses formed along the upper and inner portion of each of the side walls 25 and 26. The opposing recesses are generally indicated at 34 and 35. When the lid is slidingly engaged with the body portion of the dispenser, the flanges will ride within the opposing recesses 34 and 35 until the rear wall 33 comes into engagement in vertical alignment with the rear wall 24 of the body portion of the dispenser. In this position, the front or leading edge 30 of the lid 21 will be spaced a slight vertical distance above the upper portion of the front wall 23 so as to create an elongated slot 36 through which the cards are dispensed from the body portion of the dispenser. The tolerances between the flange portions of the lid and the opposing recesses in the side walls of the body portion of the dispenser are such that a lid will be substantially locked into place when in the position shown in FIGS. 1 and 1A. In order to effectuate the movement of the lid relative to the body portion of the dispenser to load additional cards therein, a small keyed recess 38 is provided in the uppermost portion of the rear wall 24 for purposes of permitting a small tool or key to be inserted therein in order to pry the lid upwardly relative to the rear wall to permit a selective sliding movement of the lid relative to the body portion.

As previously discussed, the upper surface 29 of the lid is specifically designed to be free of any obstructions or openings so that a portion thereof may be used to selectively display advertising or identification indicia such as shown at 29'. The available advertising space will enable the dispenser of the present invention to be used by corporations and/or businesses as effective promotional sources or materials Mounted within the body portion of the dispenser is a positively biased inner bottom wall or card support plate 39 which is of a size which is substantially equal to the inner dimensions of the body portion as defined by the front, rear and side walls thereof. The card support plate is preferably formed of a plastic material having a plurality of integrally formed depending resilient leg or spring members 40 formed therein. The card support plate is shown in top plan view in FIG. 2 with portions of the spring biasing members or legs 40 being shown in compressed and extended position in FIGS. 2B and 2C, respectively. As shown in FIG. 2, six such resilient leg portions are shown as being in generally symmetric relationship with respect to one another. In this manner, tee force applied by the legs in elevating the card support plate is generally consistent throughout the total area thereof. Due to the equal application of pressure on the card elevating plate, any cards carried thereby will be raised in a uniform and parallel manner relative to the lid of the dispenser. Although six such legs are shown in the drawings, it is believed that four or more even numbers of geometrically spaced spring members would be appropriate.

In order to retain the card support plate 39 within the body portion of the dispenser, the plate is provided with a plurality of outwardly extending guide flanges designated at 41. Each of the guide flanges is guidingly received within vertical slots 42 formed in the side wall 26 and front wall 27. It is noted that the slots 42 extend from the bottom wall 27 of the body portion and terminate at a point below the upper edge of the front and side wall. Therefore, the upper portion of the side and front walls provide a stop to insure that the resiliently urged card support plate cannot be dislodged from the body portion of the dispenser. Additionally, although four such flanges and slots are shown in the drawings, it is envisioned that the number of such guide flanges and cooperating slots could be varied so long as sufficient members and slots are provided to positively retain the card elevating member in proper position within the body portion of the dispenser.

To insure a compact size of card dispenser and also to insure that the dispenser has generally continuous and uninterrupted upper and lower surfaces, the card dispenser of the present invention includes a specially designed ejector mechanism that is generally indicated at 45. The ejector mechanism 45 includes an elongated and generally planar body portion 46 which is of a height to extend between the inner surface of the lower wall 27 and the bottom surface of the lid 21 as shown in FIGS. 2B and 2C. The body portion is vertically oriented and in sliding engagement with the inner surface of side wall 25. The length of the body 46 is less than the length of the side wall so that the body portion may move longitudinally relative thereto. An elongated slot 47 is provided through the rear end portion 48 of the ejector mechanism 45 for purposes of allowing clearance for an inwardly extending mounting stud or member 49 which is integrally molded and extends inwardly from the inner surface of the side wall 25 for purposes of which will be described in greater detail hereinafter.

The ejector mechanism is provided with a perpendicularly oriented and depending ejection flange 50 which extends outwardly from the rear portion 48 thereof. The flange 50 is reinforced by an integrally formed triangular web 51 which extends from the upper surface 52 of the body portion of the ejector mechanism to the upper portion of the ejector flange 50. The ejector flange 50 and web 51 extend outwardly from the body portion of the ejector mechanism a distance equal to approximately half the width of the body portion of the dispenser. The front or leading wall 53 of the reinforcing web 51 is tapered as shown in detail in FIG. 5 of the drawings In this manner, the leading edge of the web will not interfere with the operation of the ejector mechanism as it is moved relative to a stack of cards being carried within the dispenser but will cause the web to ride over any cards in its path. However, the depending flange 50 is of a size to engage the rear end of the vertically adjacent card in a stack of cards contained within the dispenser. By way of example, the typical business card may have a thickness of approximately 0.010 to 0.012 inch. Therefore, the depending flange 50 will extend downwardly below the reinforcing flange 51 by a distance of approximately 0.006 to 0.008 inch. The reinforcing flange 51 will also act as an alignment surface for assuring that the uppermost card is generally horizontally aligned in planar relationship with respect to the flange element 50 thereby facilitating the ejection of cards by the movement of the ejector mechanism within the body portion thereof.

The ejector mechanism also includes a pair of spaced flange elements 55 and 56 which extend outwardly from a middle portion of one of the side walls of the body portion 46. The elements 55 and 56 extend through an opening 60 which is provided in the side wall portion 25 of the body of the dispenser. Each of the elements 55 and 56 include outwardly biased leg portions 61 and 62 as shown in FIGS. 2B and 2C which are selectively and resiliently engaged within the recess 63 of an operating or push button 64 which is frictionally secured thereto. The push button 64 is shown as being mounted on the exterior of the dispenser case along the side wall 25 and is of a size to overly the opening or slot 61 therein.

The ejector mechanism of the present mechanism is positively biased to a rearward or fully retracted position interiorly of the case by a resilient member or rubberband 65 which is disposed about the mounting flange 49 and the flange element 56 carried by the ejector mechanism. Once the resilient band has been installed, the ejector is oriented so that the elements 55 and 56 extend through the slot or opening 60 in the side wall 25 and thereafter the push button 64 is frictionally secured so as to retain the elastic band in locked position relative to the ejector mechanism.

To provide clearance and to further provide for a compact structure for the dispenser, the inner surface of the side wall 25 includes a recessed area 70 which provides clearance for the elastic band. The recessed area 70 extends from one side of the stud 49 to adjacent the remote end of the slot 60 and thereby provides sufficient clearance for the elastic band either when extended or retracted. In addition, to provide clearance for the flange 50 of the ejector mechanism so that the flange will be seated rearwardly of the uppermost card in the stack of cards within the dispenser, a recess 72 is formed in the inner surface of the end wall 24 adjacent the upper edge thereof. The recess will permit the depending flange 50 to be seated within the wall portion 24 and just rearwardly of the stack of cards when the ejector is in its fully retracted position within the dispenser.

In the use of the card dispenser of the present invention, the lid 21 of the dispenser may be slideably oriented with respect to the body portion so as to create an opening into which business, calling or other types of personalized cards may be inserted in stacked vertical relationship with respect to one another. As the cards are loaded within the dispenser, the card support plate 39 will be urged into a position adjacent the bottom wall 27 thereof In this position, the integral spring legs 40 of the plate will be under maximum tension forcing the cards upwardly against the lid 21. When the lid is secured in its locked relationship as shown in FIG. 1 and FIG. 1A with respect to the body portion of the dispenser, the ejector mechanism will be located in its fully seated position as reflected by the position of a push button 64 in FIG. 1.

Figure 5:
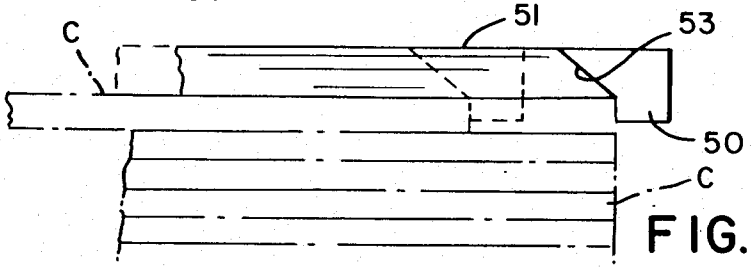
FIG. 5 is an enlarged side elevational view taken in the area of circle 5—5 in FIG. 4 and showing the movement of the card ejector mechanism in full and dotted line position.
Figures 9, 10, 11, 12:
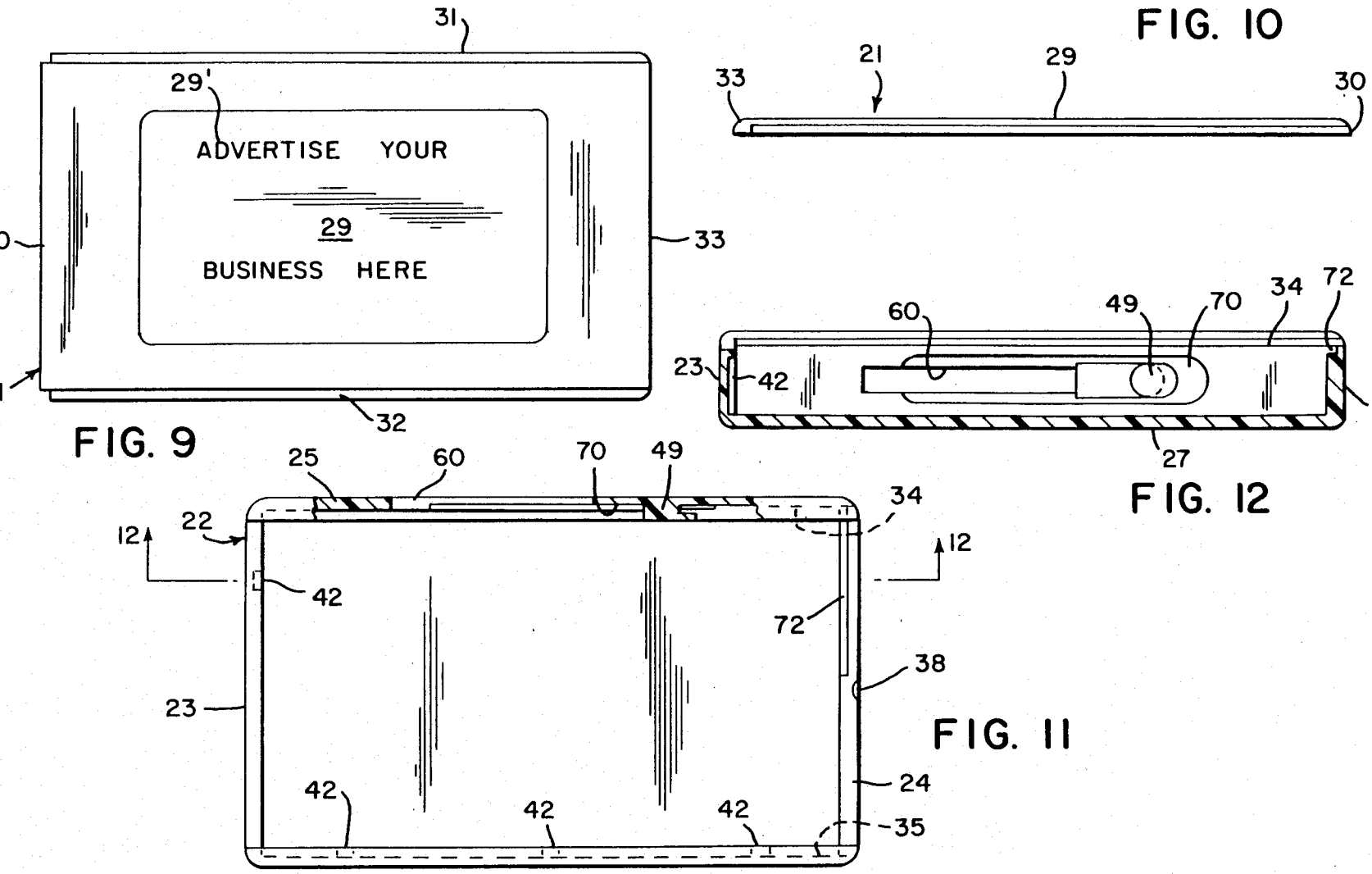
FIG. 9 is an enlarged top plan view of the lid of the present invention.
FIG. 10 is a side elevational view of the lid of FIG. 9.
FIG. 11 is an enlarged top plan view of the base portion of the card dispenser of the present invention having portions broken away showing a recessed area along one side wall of the base.
FIG. 12 is a cross sectional view taken along lines 12—12 of FIG. 11.

To dispense a card from the dispenser, the push or thumb button 64 is merely urged forwardly within the slot 60 thereby causing the ejector flange 50 to engage the rear of the uppermost card contained within the dispenser case as shown in FIG. 5. As the ejector moves forward, the card is forced outwardly of the opening 36 in the front end portion of the dispenser by a distance sufficient for the card to be engaged and pulled outwardly by the person utilizing the dispenser. Thereafter, the push button is released and the ejector mechanism is automatically returned under the influence of the rubberband or resilient member 65 which pulls the ejector back into its fully seated or retracted position wherein the flange 50 is seated within the slot 72 in the rear wall of the case. As the cards are dispensed, the card support plate will continue to raise the stack of cards relative to the ejector mechanism applying sufficient and uniform pressure so as to insure that the cards are appropriately and horizontally aligned with the ejector flange so that the cards may be uniformly urged from the dispenser without causing any bending or tearing of the cards as they are moved through the opening 36 therein.

In construction, it is preferred that each of the elements of the dispenser of the present invention, with the exception of the resilient band, be molded from a fairly rigid plastic material although metallic materials could be used in some instances.

I claim:

1. A dispensing apparatus for sequentially dispensing a plurality of cards such as business or calling cards comprising a case having a lid and a body portion, said lid having forward and rear ends, a generally continuous and planar upper surface and a pair of outwardly extending side flanges, said body portion of said case having forward, rear and spaced side walls and a bottom wall, a pair of opposing elongated recesses formed in each of said side walls of said body portion in which said flanges of said lid are selectively and slidingly received, an elongated slot formed between said forward end of said lid and said forward wall of said base through which the cards are selectively dispensed, card support means movably housed within said body portion of said case and being of a size to extend substantially between said forward, rear and side walls thereof, guide means for securing said card support means within said body portion of said case, resilient means mounted between said card support means and said bottom wall for urging said card support means upwardly toward said lid of said case, an ejector means slideably disposed within said body portion of said case, said ejector means having a generally planar body portion which is slideably oriented with respect to and adjacent one of said side walls of said body portion, said ejector means including a depending ejector ledge which extends perpendicular from said body portion outwardly toward said opposite side wall of said body portion of said case and along said rear wall of said body portion of said case, an opening in said one of said side walls, push button means connected to said body portion of said ejector means through said opening in said one of said side walls, a first inwardly extending support means integrally formed with said one of said side walls adjacent said opening therein, said ejector means having a slotted opening in said body portion through which said support means is oriented, and at least one outwardly extending flange element integrally formed with said body portion and extending through said opening in said one of said side walls of said body portion of said case, and a resilient means mounted over said support means and said flange element for urging said ejector means inwardly of said casing.

2. The dispensing apparatus of claim 1 including a recess formed in said rear end wall, said recess being of a size to cooperatively receive said ejector ledge of said ejector means whereby said ejector ledge is normally seated within said recess when said ejector means is retracted within said housing by said resilient means.

3. The dispensing apparatus of claim 2 in which said ejector means includes a reinforcing flange extending forwardly of and between said ejector ledge and said body portion of said ejector means, said reinforcing flange having an inclined forward edge portion which tapers downwardly and rearwardly relative to said bottom wall of said body portion of said case.

4. The dispensing apparatus of claim 3 in which said resilient means is a continuous band which is mounted over said support means and said flange element.

5. The dispensing apparatus of claim 1 in which said one of said side walls includes a recessed portion within said body portion which surrounds said opening therethrough, said recessed portion providing clearance for said resilient means which extends between said support means and said flange element.

6. The dispensing apparatus of claim 5 including indicia along said planar upper surface of said lid means.

7. The dispensing apparatus of claim 5 in which said guide means for securing said card support means includes a plurality of outwardly extending flange elements integrally formed with said support means, a plurality of vertically spaced grooves in at least one of said side and said end walls, said grooves terminating in spaced relationship from the upper portion of said at least one of said side and said end walls, said flange elements being selectively seated and guided within said grooves.

8. The dispensing apparatus of claim 7 in which said resilient means for urging said card support means includes a plurality of generally symmetrically spaced integrally formed and depending resilient leg members which extend downwardly from said card support means into engagement with said bottom wall of said body portion of said case.

9. The dispensing apparatus of claim 8 including an opening in said rear wall of said body portion of said case adjacent the upper edge thereof.

10. The dispensing apparatus of claim 9 in which said forward end of said lid portion is generally coextensive with said upper surface thereof and said rear end portion includes a downwardly extending flange which is substantially alignable with said rear wall of said body portion of said casing.

11. A dispensing apparatus for sequentially dispensing a plurality of rectangularly shaped cards such as business or calling cards comprising a case having a lid and a body portion, said lid having forward and rear ends, a generally continuous and planar upper surface upon which indicia may be displayed and a pair of outwardly extending side flanges, said body portion of said case having forward, rear and spaced side walls and a bottom wall which define a card retaining chamber which is just slightly larger in dimension and of the same rectangular configuration of the cards to be placed therein, a pair of opposing elongated recessed formed in each of said side walls of said body portion in which said flanges of said lid are selectively and slidingly received, an elongated slot formed between said said forward end of said lid and said forward wall of said base through which the cards are selectively dispensed, generally planar card support means movably housed within said body portion of said case and being of a size to extend substantially between said forward, rear and side walls thereof, guide means for securing said card support means within said body portion of said case, resilient means mounted between said card support means and said bottom wall for urging said card support means upwardly toward said lid of said case, an ejector means slideably disposed within said body portion of said case, said ejector means having a generally planar body portion which is slideably oriented with respect to an adjacent one of said side walls of said body portion, said ejector means including a depending ejector ledge which extends perpendicular from said body portion outwardly toward said opposite side wall of said body portion of said case and along said rear wall of said body portion of said case, and a recess formed in said rear end wall, said recess being of a size to cooperatively receive said ejector ledge of said ejector means therein so that said ejector ledge is normally seated within said recess when said ejector means is retracted within said housing, an opening in said one of said side walls, push button means connected to said body portion of said ejector means through said opening in said one of said side walls, resilient means for urging said ejector means inwardly of said casing, a first inwardly extending support means integrally formed with said one of said side walls adjacent said opening therein, said ejector means having a slotted opening in said body portion through which said support means is oriented, and at least one outwardly extending flange element integrally formed with said body portion and extending through said opening in said one of said side walls of said body portion of said case, and said resilient means being a continuous band which is mounted over said support means and said flange element.

12. The dispensing apparatus of claim 11 in which said ejector means includes a reinforcing flange extending forwardly of and between said ejector ledge and said body portion of said ejector means, said reinforcing flange having an inclined forward edge portion which tapers downwardly and rearwardly relative to said bottom wall of said body portion of said case.

13. The dispensing apparatus of claim 11 in which said one of said side walls includes a recessed portion which surrounds said opening therethrough, said recessed portion providing clearance for said resilient means which extends between said support means and said flange element.

14. The dispensing apparatus of claim 11 in which said guide means for securing said card support means includes a plurality of outwardly extending flange elements integrally formed with said support means, a plurality of vertically spaced grooves in said side walls and a groove in at least one of said end walls, said grooves terminating in spaced relationship from the upper portion of said said side and said end walls, said flange elements being selectively seated and guided within said grooves.

15. The dispensing apparatus of claim 14 in which said resilient means for urging said card support means includes a plurality of generally symmetrically spaced integrally formed and depending resilient leg members which extend downwardly from said card support means into engagement with said bottom wall of said body portion of said case.

16. A dispensing apparatus for sequentially dispensing a plurality of cards such as business or calling cards comprising a case having a closure portion and a body portion, said body portion of said case having first and second end walls, spaced side walls and a bottom wall, an elongated slot formed along said first end wall of said base through which the cards are selectively dispensed, card support means movably housed within said body portion of said case and being of a size to extend substantially between said first and second end walls and said side walls thereof, guide means for securing said card support means within said body portion of said case, resilient means mounted between said card support means and said bottom wall for urging said card support means upwardly therefrom, an ejector means slideably disposed within said body portion of said case, said ejector means having a generally planar body portion which is slideably oriented with respect to and adjacent one of said side walls of said body portion, said ejector means including a depending ejector ledge which extends perpendicular from said body portion outwardly toward said opposite side wall of said body portion of said case and along said rear wall of said body portion of said case, an opening in said one of said side walls, push button means connected to said body portion of said ejector means through said opening in said one of said side walls, a first inwardly extending support means integrally formed with said one of said side walls adjacent said opening therein, said ejector means having a slotted opening in said body portion through which said support means is oriented, and at least one outwardly extending flange element integrally formed with said body portion and extending through said opening in said one of said side walls of said body portion of said case, and resilient means mounted over said support means and said flange element for urging said ejector means inwardly of said case.

* * * * *